US009316398B2

(12) United States Patent
Nilsson

(10) Patent No.: US 9,316,398 B2
(45) Date of Patent: Apr. 19, 2016

(54) COMBUSTION CHAMBER WITH A WALL SECTION AND A BRIM ELEMENT

(75) Inventor: Ulf Nilsson, Whetstone (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 344 days.

(21) Appl. No.: 13/978,948

(22) PCT Filed: Feb. 1, 2012

(86) PCT No.: PCT/EP2012/051652

§ 371 (c)(1),
(2), (4) Date: Oct. 1, 2013

(87) PCT Pub. No.: WO2012/110315

PCT Pub. Date: Aug. 23, 2012

(65) Prior Publication Data

US 2014/0020397 A1 Jan. 23, 2014

(30) Foreign Application Priority Data

Feb. 18, 2011 (EP) ..... 11155020

(51) Int. Cl.

| | |
|---|---|
| ***F23R 3/04*** | (2006.01) |
| ***F23R 3/34*** | (2006.01) |
| ***F23M 5/02*** | (2006.01) |
| ***F23R 3/28*** | (2006.01) |

(52) U.S. Cl.

CPC ..... *F23R 3/343* (2013.01); *F23M 5/025* (2013.01); *F23R 3/04* (2013.01); *F23R 3/283* (2013.01); *F23D 2214/00* (2013.01); *F23D 2900/00016* (2013.01); *F23R 2900/00004* (2013.01); *F23R 2900/03042* (2013.01); *F23R 2900/03043* (2013.01)

(58) Field of Classification Search

CPC ..... F23R 3/343; F23R 3/04; F23R 3/283; F23R 3/12; F23R 3/14; F23R 2900/00004; F23R 2900/03042; F23R 2900/03043; F23M 5/025; F23D 2900/00016; F23D 2214/00

USPC ..... 60/740, 743, 744, 745, 748

See application file for complete search history.

(56) References Cited

U.S. PATENT DOCUMENTS

| | | | | |
|---|---|---|---|---|
| 3,808,803 | A * | 5/1974 | Salvi | F23R 3/14 239/400 |
| 5,264,244 | A | 11/1993 | Edwards, III | |
| 5,266,360 | A | 11/1993 | Edwards, III | |
| 5,315,822 | A | 5/1994 | Edwards, III | |
| 5,393,220 | A | 2/1995 | Couwels | |
| 5,761,906 | A * | 6/1998 | Norster | F23C 7/002 60/737 |
| 5,805,973 | A | 9/1998 | Ackerman | |

(Continued)

FOREIGN PATENT DOCUMENTS

| | | |
|---|---|---|
| EP | 0728989 A2 | 8/1996 |
| EP | 1001221 A2 | 5/2000 |

(Continued)

*Primary Examiner* — Steven Sutherland

(57) ABSTRACT

A combustion chamber for a gas turbine is proposed. The combustion chamber has a wall section and a brim element. The wall section has an inlet aperture for injecting a cooling medium into the combustion chamber. The brim element is mounted to an inner face of the wall section. The brim element is formed in such a way that a projected area of the brim element onto the inner face along a direction of a normal of the inner face at least partially covers the inlet channel.

13 Claims, 5 Drawing Sheets

(56) References Cited

U.S. PATENT DOCUMENTS

| | | | | |
|---|---|---|---|---|
| 5,833,141 | A | 11/1998 | Bechtel, II | |
| 6,123,273 | A | 9/2000 | Bechtel, II | |
| 6,532,726 | B2 * | 3/2003 | Norster | F23C 7/002 60/39.281 |
| 6,718,770 | B2 * | 4/2004 | Laing | F23D 11/06 239/548 |
| 7,926,178 | B2 * | 4/2011 | Thomson | F23D 11/36 228/135 |
| 2009/0255262 | A1 * | 10/2009 | McMasters | F23R 3/14 60/742 |

FOREIGN PATENT DOCUMENTS

| | | | |
|---|---|---|---|
| EP | 2026002 | A1 | 2/2009 |
| GB | 2336663 | A | 10/1999 |

* cited by examiner

COMBUSTION CHAMBER WITH A WALL SECTION AND A BRIM ELEMENT

CROSS REFERENCE TO RELATED APPLICATIONS

This application is the US National Stage of International Application No. PCT/EP2012/051652 filed Feb. 1, 2012 and claims benefit thereof, the entire content of which is hereby incorporated herein by reference. The International Application claims priority to the European application No. 11155020.8 EP filed Feb. 18, 2011, the entire contents of which is hereby incorporated herein by reference.

FIELD OF INVENTION

The present invention relates to a combustion chamber for a gas turbine and to a method for controlling a flow of a cooling medium inside a combustion chamber for a gas turbine.

ART BACKGROUND

In combustion chambers of gas turbines fuel is burned for generating thermal energy. The combustion chamber comprises a burner body with a pilot burner face which comprises a liquid fuel lance having a conduit for guiding the liquid fuel to a tip, the tip for injecting pilot fuel and holes in the tip for injecting cooling air. The holes for injecting cooling air are generally formed in and around the liquid fuel tip. The cooling air may be guided along the liquid fuel lance to its tip in an annulus between the liquid fuel lance and the bore through the burner body in which it is installed. The cooling air is normally supplied from the gas turbine compressor discharge utilizing the same available pressure drop as the main flow through the burner, however flowing in a parallel stream for the two flows to be joined in the burner cavity. The upstream wall of the burner cavity, i.e. the pilot burner face, may reach temperatures between approximately 800°-1000° C. (Celsius) during operation. The holes for injecting cooling air cools the lance tip and the injected cooling medium interacts with the fuel injected from the lance tip to create a homogeneous air/fuel mixture. In order to achieve a combustion with low emissions, it is a need to achieve a high degree of atomization of the fuel in a main operating range. During a start-up phase and during low load operation of the gas turbine, a less distributed fuel spray is generated, due to the reduced mass flow and pressure, which increases the tendency of the fuel to deposit on the lance tip and the adjacent areas. During operation the fuel covered surfaces on the pilot burner surface may coke and carbonize, such that a hard and adhesive coating is generated. This coke and carbonization onto the pilot burner face may lead to a blockage of the holes for injecting the cooling medium. Hence, the temperature of the lance tip may increase and the fuel flow through the lance tip may ultimately stop if the fuel orifice of the lance tip is blocked by carbonized fuel.

FIG. 5 illustrates a common combustion chamber 500 comprising a burner body 110 with a common wall section 501. Through the common wall section 501, a pilot fuel is injectable along an axial direction of the common combustion chamber 500. Through the common wall section 501, the pilot fuel and a cooling medium is injectable in a predefined direction 107. Moreover, an igniter 502 is attached to the burner body 110 in order to ignite the injected fuel during start-up.

In surrounding shell sections of the common combustion chamber 500 a swirler 503 is formed, wherein the swirler 503 is adapted for injecting a main fuel/air stream 504 in a circumferential direction. The injected pilot liquid fuel stream and the injected cooling medium are injected for controlling the combustion of the main fuel/air mixture stream 504 which flows through the swirler 503 of the common combustion chamber 500.

As shown in more detail in FIG. 6, the common wall section 501, which may be a part of a fuel lance that is inserted in the pilot burner body 110, comprises common inlet holes 601 that are formed circumferentially around a fuel injection aperture 106 as to promote the characteristics of the spray. Through the fuel injection aperture 106 the pilot fuel is injected into the common combustion chamber 500 in a predefined direction 109. The common inlet holes 601 have a cross-section through which cooling medium is injected which interacts with the pilot fuel injected in the direction 109 through the fuel injection aperture 106 of the pilot lane. Hence, the entered fuel may carbonize inside the common inlet holes 601 due to the high temperature inside the common combustion chamber 500 and thus block the common inlet holes 601.

U.S. Pat. No. 5,833,141 A discloses an anti-coking dual-fuel nozzle for a gas turbine combustor. The dual-fuel nozzle comprises a liquid fuel nozzle surrounded by an air/gas pre-mixing cup. The cup has a base comprised of swirler vanes surrounding the outer tube of the liquid fuel nozzle. The air/gas cup surrounds the liquid fuel nozzle such that channels between the liquid fuel nozzle and the air/gas pre-mixing cup are formed. In a downstream end section of the air/gas pre-mixing cup, the air/gas pre-mixing cup comprises a conical section.

U.S. Pat. No. 6,123,273 A discloses a dual-fuel nozzle for inhibiting carbon deposition onto combustor surfaces in a gas turbine. The dual-fuel nozzle comprises a liquid fuel nozzle surrounded by a gas fuel nozzle. A converging sleeve surrounds the converging outer wall of the combined liquid fuel and gaseous nozzle to form a duct of decreasing cross-sectional areas in a downstream direction, such that an airflow through the duct accelerates towards the conical droplet spray pattern emerging from the liquid fuel nozzle. The accelerated air flowing through the duct precludes an impingement of oil spray droplets onto metal surfaces of the nozzle.

In other approaches, the critical surfaces of the elements of a gas turbine that are in contact with fuel are coated with high temperature alloys with a coke inhibiting layer.

SUMMARY OF THE INVENTION

It is an objective of the present invention to provide a combustion chamber with a reduced risk of clogging injection holes.

This objective may be solved by a combustion chamber for a gas turbine and by a method for controlling a flow of the cooling medium inside a combustion chamber for a gas turbine according to the subject-matter of the independent claims.

According to a first aspect of the present invention, a combustion chamber for a gas turbine is presented. The combustion chamber comprises a wall section and a brim element. The wall section comprises an inlet channel for injecting a cooling medium into the combustion chamber. The brim element is mounted to an inner face of the wall section, in particular is a part of the inner face, wherein the brim element is formed in such a way that a projected area of the brim element onto the inner face along a direction of a normal of the inner face at least partially covers the inlet channel.

According to a further aspect of the present invention, a method for controlling a flow of a cooling medium inside the combustion chamber for a gas turbine is presented. The cooling medium is injected into the combustion chamber through at least one inlet channel of a wall section of the combustion chamber. The flow of the cooling medium inside the combustion chamber is controlled by a brim element being mounted to an inner face of the wall section. The brim element is formed in such a way that a projected area of the brim element onto the inner face along a direction of a normal of the inner face at least partially covers the inlet channel.

The combustion chamber is generally formed in a tubular-like shape with a center axis. Along the centre axis, the combustion chamber may comprise a pre-chamber at the outlet of the burner with a smaller diameter and a main chamber with a larger diameter than the pre-chamber. The pre-chamber is defined by a shell surface extending generally in an axial direction, downstream of the swirler, with respect to the center axis. Radially inside the swirler at the upstream side relative to the main flow direction in the combustion chamber the wall section is located, which may be a part of a fuel lance that is inserted in the pilot burner body attached to the combustion chamber. The wall section and a burner face of the pilot burner body run in general in a radial direction with respect to the center axis. The wall section may form the end section of the fuel lance and may comprise a pilot tip. The face of the wall section that faces the inside of the combustion chamber is the inner face. The wall section with its pilot tip is mounted to the pilot burner body.

To the wall section the inlet channel is formed, through which the cooling medium is injectable inside the combustion chamber. Additionally, through the wall section a pilot fuel stream is injectable into the pre-chamber. The injected pilot fuel forms the pilot fuel stream, which is adapted for controlling the combustion stability of the main/fuel air mixture. The main fuel/air mixture is generally injected, e.g. by a swirler which is attached to the shell surface of the combustion chamber, e.g. the pre-chamber.

The inlet channel is formed to the wall section in such a way, that through the pilot burner, in particular through the pilot fuel lance, i.e. the wall section, inserted into the pilot burner, a cooling medium is injectable inside the combustion chamber, so that at least a part of the face of the wall section is cooled. Moreover, the inlet channel is formed in such a way that the cooling medium streaming through the inlet channel is injected in such a way, that also additional elements, such as the inlet nozzle for the pilot fuel, is cooled as well by the cooling medium.

The cooling medium may be for example air, steam, a gas fuel e.g. natural gas, a fluid, such as water, or other cooling fluids which are suitable for cooling the pilot burner face. Preferably, a cooling medium is applied that cools the pilot burner face and is additionally usable for supporting the combustion inside the combustion chamber, such as an oxidant, e.g. air or carbondioxid.

The carbonisation may have different causes. As described above, during start-up and low load operation fuel may carbonize onto surfaces of the combustion chamber. Moreover, most gas turbines are designed for so called dual fuel operation, wherein a main fuel is typically natural gas and a back up fuel which is typically a heating oil or kerosene. During operation it is possible to switch between the fuels without stopping the gas turbine. It may even be possible to continuously run on both fuels at the same time. In such a situation it may be an option to use natural gas instead of air to keep the lance tip cool. The gas fuel is cooler than the air from the compressor and would have a marginal impact on emissions particularly if traded off against the gas pilot fuel flow.

The brim element may be a separated element which is attached and thus mounted to the inner face of the wall section or may be integrally formed (monolithically) with the wall section. The brim element may for example extend in a similar plane as the inner face. Alternatively, the brim element may have an extension along the plane of the inner face and additionally along the axial direction of the combustion chamber. The brim element generates a projected area onto the inner face along a direction of the normal of the inner face. The projected area at least partially covers the inlet channel. The inlet aperture, through which the cooling medium streams out into the burner, is in particular defined between an edge of the brim element and the surface of the inner face and/or a surface of the inlet channel. In particular, the inlet channel may form at its end section a groove in the wall section along the inner face. The projected area of the brim element at least partially covers the end section of the inlet channel, i.e. the groove. The brim element is mounted to an edge of the inner face at which the inlet channel leaves the body of the wall section. The brim element may be a protrusion extending parallel to the inner face over a part of the groove and the end section of the inlet channel. The brim element may be a thin plate-like element. Between the brim element and the (plane of the) inner face an angle between approximately 0° and approximately 60° (degree) may be defined.

Hence, along the axial direction and/or along the direction of the normal of the inner face, a back-streaming of the fuel upwards with respect to the injection direction inside the inner channel is at least partially blocked by the brim element. For this reason, the reduced back-flow in upstream direction reduces the risk of clogging and blocking of fuel inside the hole. In other words, the brim element is formed in such a way, that an inlet aperture through which the cooling medium streams into the combustion chamber is formed between the brim element and the inner face or the inlet channel. In particular, the opening area (inlet aperture) between the brim element and the inner face guides the cooling medium at least with a direction component in radial direction with respect to the centre axis because a pure axial streaming is blocked by the brim element. Hence, the cooling medium streams at least partially in circumferential direction out of the inlet aperture, relative to the injected fuel flow, and thus streams at least partially over the inner face for cooling the inner face and other elements in the combustion chamber.

Hence, by the present invention the brim element reduces the amount of fuel that flows upstream into the inlet channel. Hence, a blockage of the inlet channel by a coked or carbonized fuel is reduced such that the combustion chamber may be operated more reliably. Additionally, maintenance costs and downtime may be reduced.

According to a further exemplary embodiment of the present invention, the inlet channel has a width (diameter) of more than approximately 0.2 mm, preferably more than approximately 1 mm and less than approximately 10 mm (Millimeters).

The inlet channel may be formed with a circular, elliptical, triangular, rectangular shape or a combination thereof, for example. Hence, the width may be defined by the hydraulic diameter i.e. the diameter of the circular shape, or the semiminor axis of an elliptical shape or the distance of opposed sides of a rectangular shape. By forming the inlet channel as a single channel or only a few channels with widths of more than approximately 1 mm, a higher momentum of the cooling medium is achieved when being injected inside the combustion chamber. Hence, by using such a larger inlet channel, the risk of completely blocking the inlet channel by coke or carbonized layers is reduced.

In an exemplary embodiment of the present invention merely one or two inlet channel(s) which has (have) a width of more than approximately 1 mm are formed in the wall section for injecting the cooling medium.

According to a further exemplary embodiment, the wall section further comprises at least one further inlet channel for injecting the cooling medium in the combustion chamber. The combustion chamber further comprises at least one further brim element which is mounted to the inner face of the wall section. The further brim element is formed in such a way that the further projected area of the further brim element onto the inner face along a direction of a normal of the inner face at least partially covers the further inlet channel.

According to a further exemplary embodiment, the wall section further comprises a fuel injection aperture such that fuel is injectable into the combustion chamber. In particular, the fuel injection aperture or hole injects the pilot fuel stream into the combustion chamber. The pilot fuel stream comprises a direction component which may be parallel to the centre axis of the combustion chamber. Hence, the fuel injection aperture or hole also guides the pilot fuel stream radially (with respect to the centre axis of the fuel injection aperture.)

The fuel injection aperture is formed into the wall section, i.e. the fuel lance, for injecting fuel. The fuel lance comprises at least one fuel injection nozzle for injecting pilot fuel inside the combustion chamber. Depending on the actual size or configuration of the pilot tip of the wall section it may be preferable to have more than one fuel injection apertures in the same pilot tip.

As described above, the wall section may be a part of the fuel lance that is (detachably) insertable and fixable in the pilot burner body. According to the exemplary embodiment above, the wall section/element comprises e.g. a plurality of inlet channels that are formed circumferentially around the fuel injection aperture formed into the wall section. The pilot fuel is injected through the fuel injection aperture into the combustion chamber along an axial direction (i.e. a centre axis of the fuel injection aperture). The inlet channels together with its respective brim element form a cross-section through which the cooling medium is injected generally along a circumferential direction around the centre axis of the fuel inlet aperture.

The wall section of the fuel lance is mounted to the pilot burner body such that the wall section is surrounded by the pilot burner body. The pilot body has a burner surface that faces inside the combustion chamber. The inner face of the wall section and the burner face may run within and along a common surface plane. Furthermore, a plurality of fuel lances each comprising the respective wall section and brim elements may be mounted to the pilot burner body. In particular, the fuel lances may be located circumferentially around a centre axis of the pilot burner body.

According to a further exemplary embodiment of the present invention, the pilot tip has a width (diameter) of more than approximately 3 mm, preferably more than approximately 5 mm and less than approximately 25 mm (Millimeters).

In particular, the inlet channel for injecting the cooling medium is placed close to the fuel injection aperture for generating a sufficient cooling energy for cooling the fuel injection aperture and the fuel lance. A plurality of injection channels for injecting the cooling medium is formed preferably along a circumferential direction around the fuel injection aperture.

According to a further exemplary embodiment, the brim element is formed in such a way, that the cooling medium streaming through the inlet channel is guided along a predefined direction with respect to the fuel injection aperture.

The predefined direction defines a streaming direction of the cooling medium in the vicinity of the exit of the inlet channel inside the combustion chamber. The predefined direction may form for example a tangential direction with respect to the fuel injection aperture or a circumferential, curved direction around the fuel injection aperture. Moreover, the predefined direction may define a radial direction component, such that the cooling medium streams at least partially in a radial direction to the fuel injection aperture.

The brim element defines the predefined direction in such a way that the brim element forms the inlet aperture at a defined position with respect to the wall section. For example, the brim element forms the inlet aperture in such a way that the cooling medium streams in a tangential direction.

According to a further exemplary embodiment, the wall section further comprises the inlet channel with a groove at the end section of the inlet channel facing the combustion chamber. The groove is formed within the wall section, i.e. the inner face of the wall section. The groove is formed in such a way that the groove runs in the wall section along the inner face from the end section of the inlet channel at least partially along the predefined direction for guiding the cooling medium streaming through the inlet channel. In particular, by forming the groove within the wall section, an open, non-closed end part of the inlet channel is formed by the groove along which the cooling medium streams after leaving the inlet channel. Hence, at least a part of the cooling medium streams along the run of the groove such that when leaving the groove the streaming direction of the cooling medium is adapted to the run of the groove. For example, if the groove has a curved shape along a circumferential direction around the fuel injection aperture, the cooling medium streaming through the inlet channel and along the curved groove may comprise a direction component in a circumferential direction around the fuel injection aperture and a further direction component in axial direction of the combustion chamber. Hence, after leaving the curved groove, the cooling medium streams for example in a helical streaming direction along the axial direction.

According to a further exemplary embodiment, in the combustion chamber fuel droplets of the main fuel are injectable for streaming in a main fuel/air mixture streaming direction, wherein the main fuel/air mixture streaming direction comprises a direction component which is parallel to the inner face (i.e. orthogonal to the normal of the inner face) or which is directed to the inner face. The brim element is formed and adjusted to the wall element in such a way, that the brim element generates the inlet aperture through which the injected cooling medium is guided from a lee side of the brim element along an upstream direction of the direction component of the main fuel/air streaming direction.

The main fuel droplets, i.e. the fuel/air mixture, may be injected for streaming in a main fuel/air mixture stream direction in particular by a swirler.

The brim element forms an upwind side, which faces the upstream direction of fluid droplets, and a lee side, which faces to the downstream direction of the main fuel/air mixture stream of main fluid droplets. The brim element forms the inlet aperture upstream of the stream of fluid droplets in the region of the lee side, such that fluid droplets streaming with the main fuel/air mixture streaming direction and passing the inlet aperture and do not enter the inlet aperture.

According to a further exemplary embodiment, the inlet channel is formed within the wall section in such a way that the inlet channel comprises sections, where some sections running in an inclined helical way inside the wall section and some sections running e.g. straight inside the wall section. Hence, when forming a helical run inside the wall section, the cooling medium may cool the body of the wall section more efficiently. In particular, the wall section comprises as well the fuel injection aperture for feeding the pilot fuel to the inside of the combustion chamber. The inlet channel is formed within the wall section in such a way, that the inlet channel comprises a helical run around the fuel injection aperture.

A cooling channel is connectable to the inlet channel for supplying the cooling medium to the inlet channel. Moreover, a plurality of inlet channels may be connected to one and the same cooling channel or may be connected to a respective cooling channel. Then, each of the inlet channels may as well run helically along the axial direction, wherein each inlet channel run with respect to each other inside the wall section in a multiple start manner comparing with single and double start threads on a screw, i.e. single and double pitch threads.

According to a further exemplary embodiment, the inlet channel is formed within the wall section in such a way that the inlet channel comprises a section running parallel with respect to the normal of the inner face and/or parallel with respect to the fuel injection aperture.

According to a further exemplary embodiment, the wall section is surrounded by a spacer element. The spacer element has a width (between outer edges or the outer diameter of the spacer element) of approximately more than 1.5 times, particularly more than approximately 2 times and less than approximately 4 times that of the wall section (i.e. defined between opposed outer edges or the outer diameter of the wall element). The spacer element may be interposed between the wall section and the burner body in order to reduce gap sizes between the wall section and the burner body. In particular, the spacer element may be exchangeable, so that spacer elements with predetermined sizes may be applied, so that the spacer element may be adjusted to respective gap sizes.

Hence, increasing or reducing the effective size of the wall element, which may be made of a particular carbonization resistant material, is possible without having to increase the size of the pilot tip to which the wall section is fixed, because into a gap between edges of the burner body and the wall section an adapted spacer element may be inserted. Thus, the reliability of the combustion chamber may be improved.

According to a further exemplary embodiment, the spacer element is a titanium alloy. According to a further exemplary embodiment, the inner face of the wall section and/or the brim element is alloyed with titanium or a titanium compound. Hence, titanium is lesser reactive than other metal materials, such as steel or nickel, such that the clogging and the adhesion of carbonized fuel is reduced.

According to a further exemplary embodiment, the combustion chamber further comprises a burner body with a receiving section into which the wall section is mounted in a detachable manner. In particular, the pilot body comprises a pilot burner face which faces to the inside of the combustion chamber, wherein the receiving section is formed in the pilot burner face. Moreover, the burner body may comprise a plurality of receiving sections into which further fuel lances with respective wall sections are mountable in a detachable manner. Hence, the wall section may be formed as an insert that may be detachably mounted to the burner body. This may improve the maintenance capability, because if a wall section cracks for example, only the damaged wall section and fuel lance has to be exchanged.

By the present invention, the inlet channels for the cooling medium may be covered at least partially by a brim element and as well the size of the inlet channels may be increased, so that the probability of blockage of the cooling hole being blocked by carbonized fuel droplets. Additionally, the fuel injection apertures, the inner face, the brim elements, the inlet channel and for example further elements such as the liquid fuel lance inside the fuel inlet hole may be made of a titanium compound alloy, preferably with an ASTN grade 5 or 6. Moreover, a drain groove or a hollow plug may be provided in the wall section, wherein the drain groove may be spaced from the fuel inlet hole at least by two times of the diameter of the fuel inlet hole, such that the atomized fuel onto the inner face may be collected in the drain groove and carbonization of the fuel occurs mainly in the drain groove.

Hence, by the present invention, by providing the protected and partially covered inlet channel for the cooling medium, the exposure of the inlet channel to liquid fuel droplets is significantly reduced such that a less carbonized wall section is achieved.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
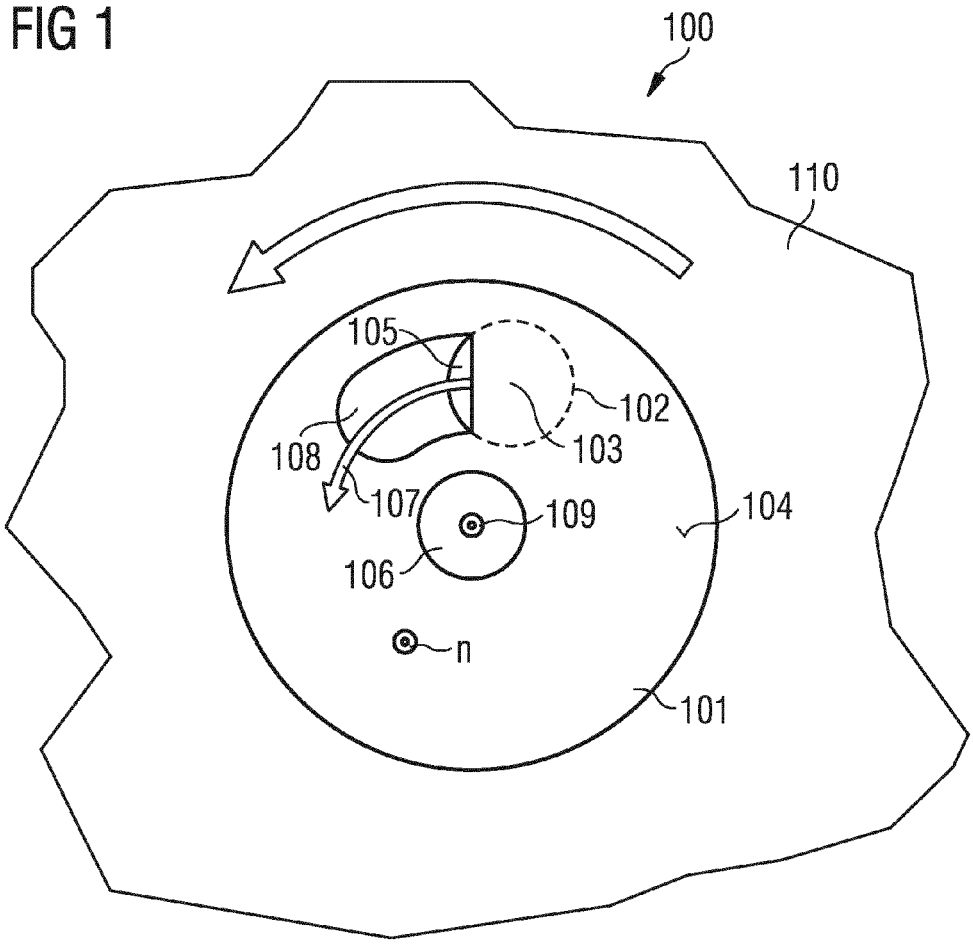
FIG. 1 shows a top view in the region of the lance tip onto an inner face of a burner body of a combustion chamber according to an exemplary embodiment of the present invention.

The illustrations in the drawings are schematical. It is noted that in different figures, similar or identical elements are provided with the same reference signs.

FIG. 1 shows a combustion chamber 100 for a gas turbine according to an exemplary embodiment of the present invention. The combustion chamber 100 comprises a wall section 101 and a brim element 103. The wall section 101 comprises an inlet aperture 105 for injecting a cooling medium into the combustion chamber 100. The brim element 103 is mounted to an inner face 104 of the wall section 101 or alternatively forms a part of the inner face 104 itself (i.e. forms a part of the wall at the end section of the helical passage of the inlet channel 102). The brim element 103 is formed in such a way that a projected area of the brim element 103 onto the inner face 104 along a direction of a normal n of the inner face 104 at least partially covers the inlet channel 102.

As shown in FIG. 1, the inlet channel 102 forms together with the edge of the brim element 103 and the inner face 104 an inlet aperture 105 in a plane substantially perpendicular to or at least angled against the plane of the inner face 104. Through the inlet aperture 105 the cooling medium (e.g. air) streams inside the combustion chamber 100.

The brim element 103 may be formed monolithically to the wall section 101 and may extend with at least one extension direction along the plane of the inner face 104. Additionally, the brim element 103 may as well comprise in a further exemplary embodiment an extension direction in the direction of the normal n of the inner face 104.

The wall section 101 further comprises a fuel injection aperture 106, through which the fuel, in particular the pilot fuel, is injectable in a direction 109 which is generally parallel to the normal n of the inner face 104. The combustion chamber 100 comprises a centre axis. The brim element 103 forms in direction of the normal n of the inner face 104 the projected area onto the inner face 104. The brim element 103 is formed in such a way that its projected area at least partially covers the inlet channel 102 with respect to its extension along the plane of the inner face 104.

Additionally, a groove 108 may be formed into the inner face 104, wherein the groove 108 forms a part of the end section of the inlet channel 102 and runs along a desired direction 107 of the cooling medium. As shown in FIG. 1, the desired direction 107 of the cooling medium may be in particular in circumferential direction around the centre axis of the fuel injection aperture 106 or the combustion chamber 100. The inlet aperture 105 is in particular defined by the edge of the brim element 103 and the surface of the groove 108. The groove 108 may be seen as a part of an end section of the inlet channel 102.

Furthermore, as shown in FIG. 1, the wall section 101 may be detachably attached to receiving sections of the burner body 110. The wall section 101 includes the fuel injection aperture 106 and the inlet channel 102 and may be replaceable e.g. if the cooling media is a fuel gas.

When the gas turbine is running or during start up, i.e. when cooling air is delivered from a compressor to the combustion chamber 100, the main acting force on the liquid fuel droplets inside the combustion chamber 100 is the flow field created by a swirler in the burner. The flow field created by the swirler forms a helical run of the fuel droplets along an axial direction in the combustion chamber 100. The main fuel i.e. fuel air mixture stream of the flow field containing the fuel droplets is indicated by the arrow printed in bold in FIG. 1. Hence, the brim element 103 is aligned at the wall element 101 in such a way, that the brim element 103 forms an inlet aperture 105 for the cooling medium. The brim element 103 forms an upwind side, which faces to the upstream direction of the fluid droplets and the main flow as indicated by the arrow in FIG. 1, and a lee side, which faces to the downstream direction of the main fuel air mixture stream direction. The brim element 103 forms the inlet aperture 105 in the region of a lee side of the brim element 103, such that no or only a few fluid droplets may stream through the inlet aperture 105 and the fluid droplets pass the inlet aperture 105. In particular, brim element 103 is formed and adjusted in such a way, that the brim element 103 and the end section of inlet channel 102 (e.g. the groove 108) generates the inlet aperture 105 through which the injected cooling medium is guided from the lee side of the brim element 103 along a direction component of the main fuel stream direction. The upstream direction component of the cooling medium is generally parallel to the inner face 104.

Figure 2:
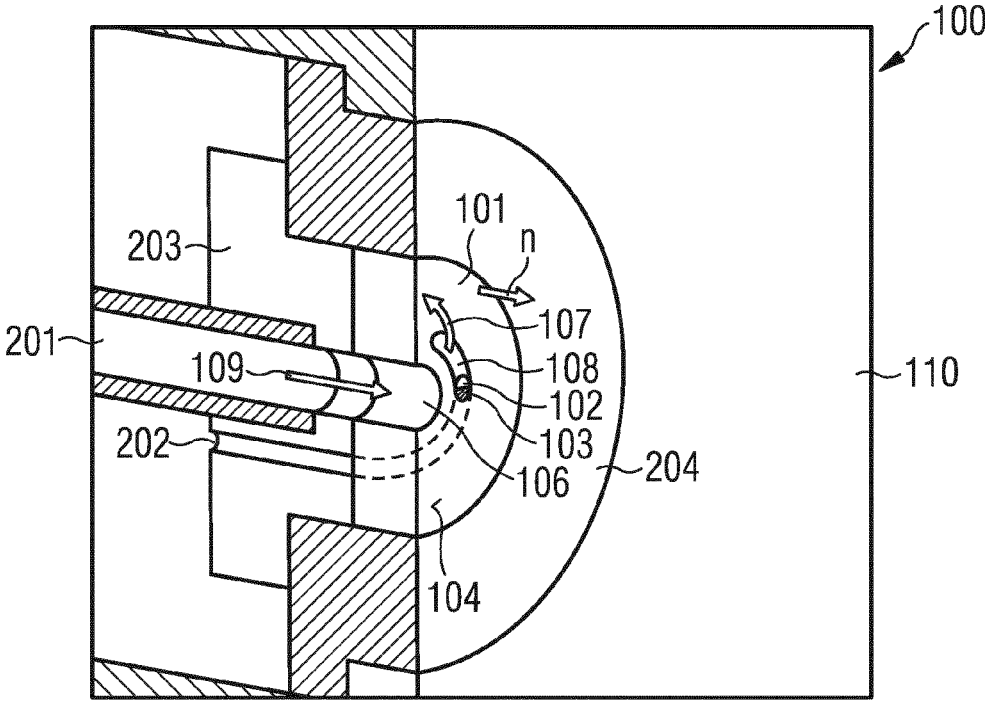
FIG. 2 shows a perspective view of a sectional view of the burner body comprising a wall section mounted to a supporting body according to an exemplary embodiment of the present invention.

FIG. 2 shows a perspective view of a combustion chamber 100. In the burner body 110 the wall section 101 is installed. The inner face 104 of the wall section 101 has the normal n. Brim element 103 is formed to the inner face 104 or the brim element 103 may be mounted for example by welding or laser deposition. The brim element 103 extends along an extending direction parallel to the inner face 104. In a further possible exemplary embodiment the brim element 103 extends at least partially in a further extending direction parallel to the normal n of the inner face 104, such that the brim element 103 is spaced from the inner face 104 in the region of the exit of the inlet aperture 102.

When projecting a projection area in the direction of the normal n on the inner face 104, the brim element 103 at least partially covers an end section of the inlet channel 102. The cooling medium, which is injected into the combustion chamber 100 through the inlet channel 102, streams substantially in a direction parallel to the normal n of the inner face 104. The cooling medium is partially guided by the brim element 103 such that a direction component of the cooling medium is parallel to the inner face 104, as indicated by the arrow 107. Preferably, the inlet aperture 105 is formed between the edge of the brim element 103 and optionally the surface of the groove 108, as shown in FIG. 1, such that the injected cooling medium is directed along a circumferential direction around the fuel injection aperture 106.

As further shown in FIG. 2, the pilot fuel is guided through a fuel channel 201 that is formed inside the wall section 101 as a continuation of a conduit allowing the fuel to enter the wall section 101 from the outside. The fuel flowing through the fuel channel 201 exits the fuel channel 201 through the fuel inlet 106 with a direction 109 which is substantially parallel to the normal n of the inner face 104, but may also have e.g. a conical shape, where the tip is located in or at the fuel inlet 106. In the vicinity of the fuel channel 201 a cooling channel 202 is formed for supplying the cooling medium through the wall section 101 to the inlet channel 102. The cooling channel 202 is formed into the wall section 101 in such a way that the cooling channel 202 is in thermal contact with the fuel channel 201. Hence, the heating up of the fuel as it passes through fuel injection aperture 106, i.e. through the fuel lance tip in the fluid injection hole 106, is reduced. Moreover, by the cooling medium a cooling of the metal in the fluid injection hole 106 is achieved.

FIG. 2 shows that the wall section 101 forms part of a pilot tip 203 which is mounted to the burner body 110. A portion of the cooling channel 202 in the pilot tip 203 runs substantially parallel to the fuel channel 201. In fact, the cooling channel 202 may be formed by the clearance between the fuel channel 201 and the bore inside the burner body 110. The wall section 101 comprises the inlet channel 102 which is connected to the cooling channel 202, wherein inlet channel 102 in the wall section 101 has a helical run around the fuel channel 201. Moreover, a spacer element 204 may be inserted in a gap between edges of the wall section 101 and edges of the burner body 110.

Figure 3:
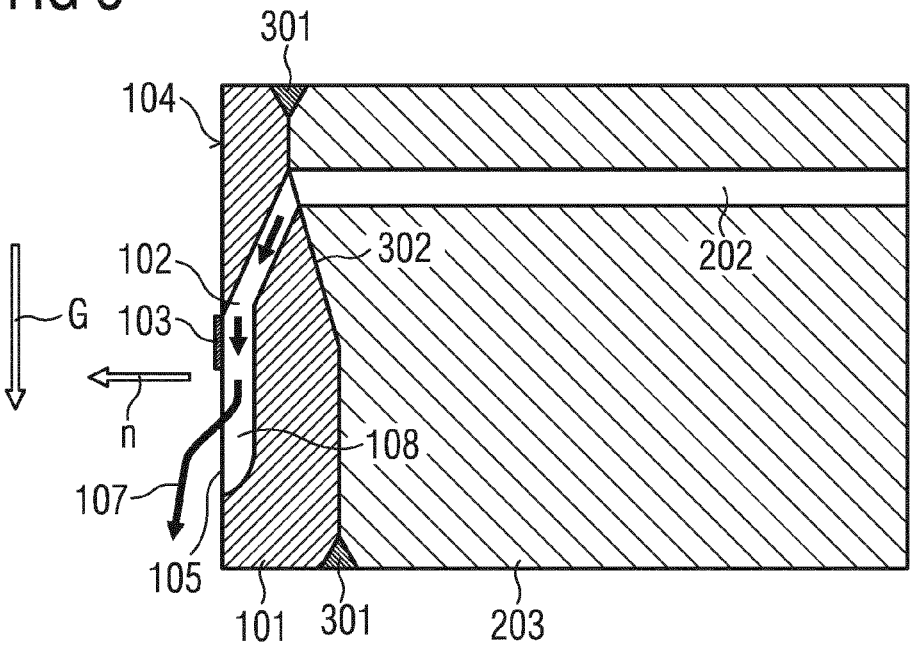
FIG. 3 shows a more detailed view of the wall section as shown in FIG. 2.

FIG. 3 discloses a more detailed view of a portion of the wall section 101 mounted to the pilot tip 203. The wall section 101 may be welded to the pilot tip 203 as indicated by the welding seam 301. Moreover, the wall section 101 may comprise a shaped element 302, such as a protrusion or groove, which is adapted to fit to a respective protrusion or groove in the pilot tip 203, if the wall section 101 is aligned in a predetermined position where the inlet channel 102 is lined up with the cooling channel 202. Hence, the assembly of the wall section 101 with respect to the pilot tip 203 is simplified.

As further shown in FIG. 3, the brim element 103 is formed monolithically with the wall section 101. The brim element 103 is projected onto the inner face 104 along a direction of a normal n of the inner face 104 at least partially covers the inlet channel 102.

Moreover, the wall section 101 as shown in FIG. 3 is rotated 180° in comparison to the wall section 101 as shown in FIG. 2. The brim element 103 may be designed in such a way that the fuel exposed on the inner face 104 flows by the force of gravity G (as indicated by the arrow) over the brim element 103 and not through the inlet aperture 105, so that the brim element 103 avoids that the fuel flows in the inlet channel 102. The brim element 103 comprises a connection point with the inner face 104 and extends with a direction component in a parallel direction to the centre of gravity G partially from the starting point over the inlet channel 102. In particular, the predetermined direction 107 of the cooling medium is directed to the bottom by the brim element 108 and the design of the groove 108. The fuel flows along the inner face 104 due to gravity over the brim element 103 to the bottom and not through the inlet aperture 105.

Figure 4:
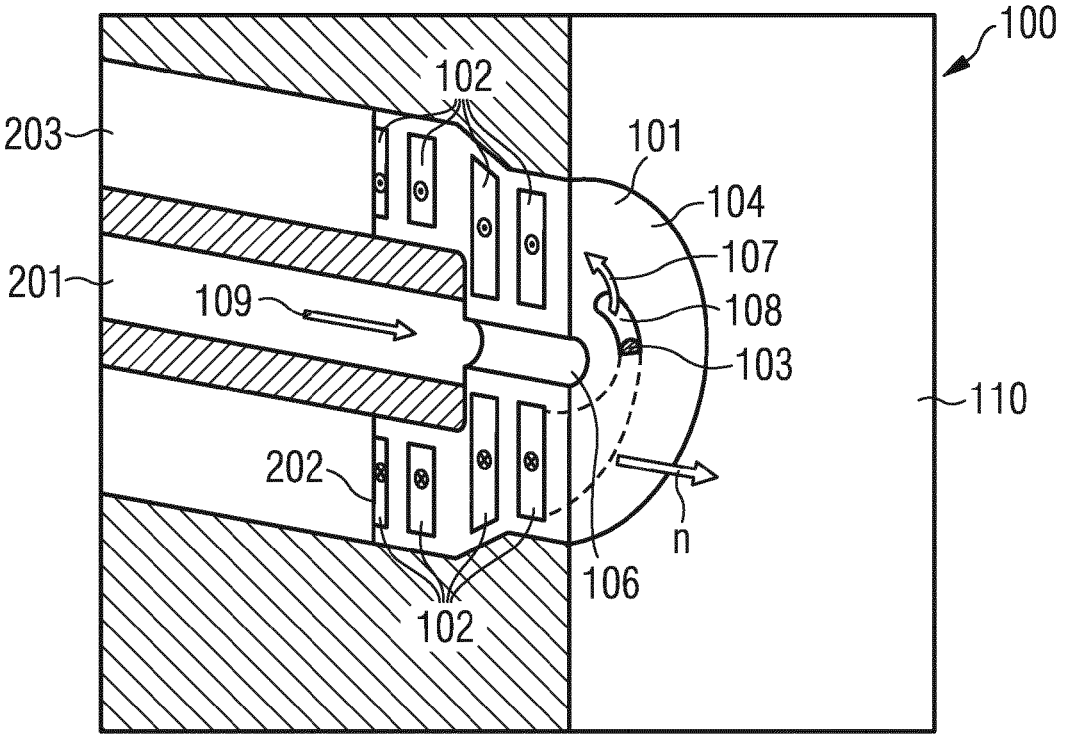
FIG. 4 shows a perspective view of a sectional view of the burner body comprising a cooling channel running in a helical direction according to an exemplary embodiment of the present invention.
Figure 5:
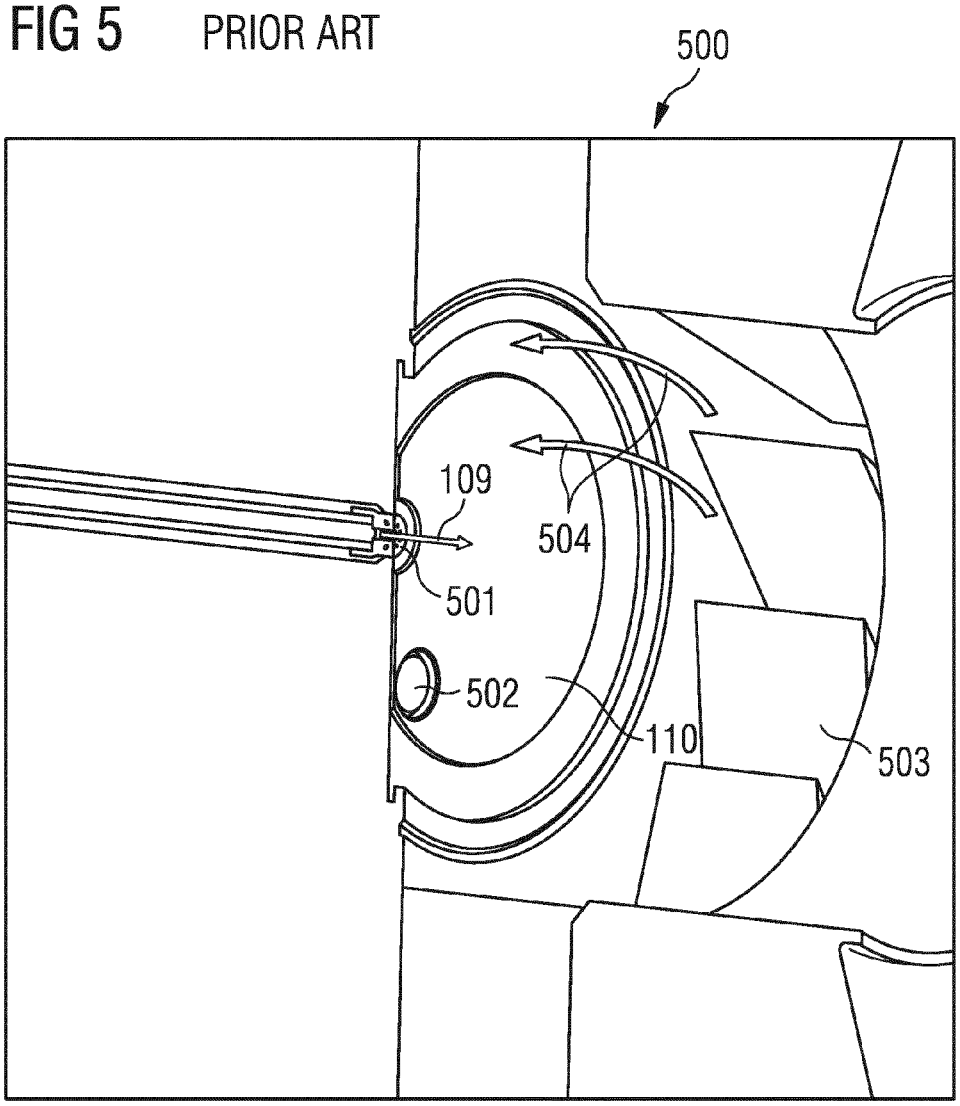
FIG 5 PRIOR ART
FIG. 5 and FIG. 6 show perspective views of a prior art wall section.
Figure 6:
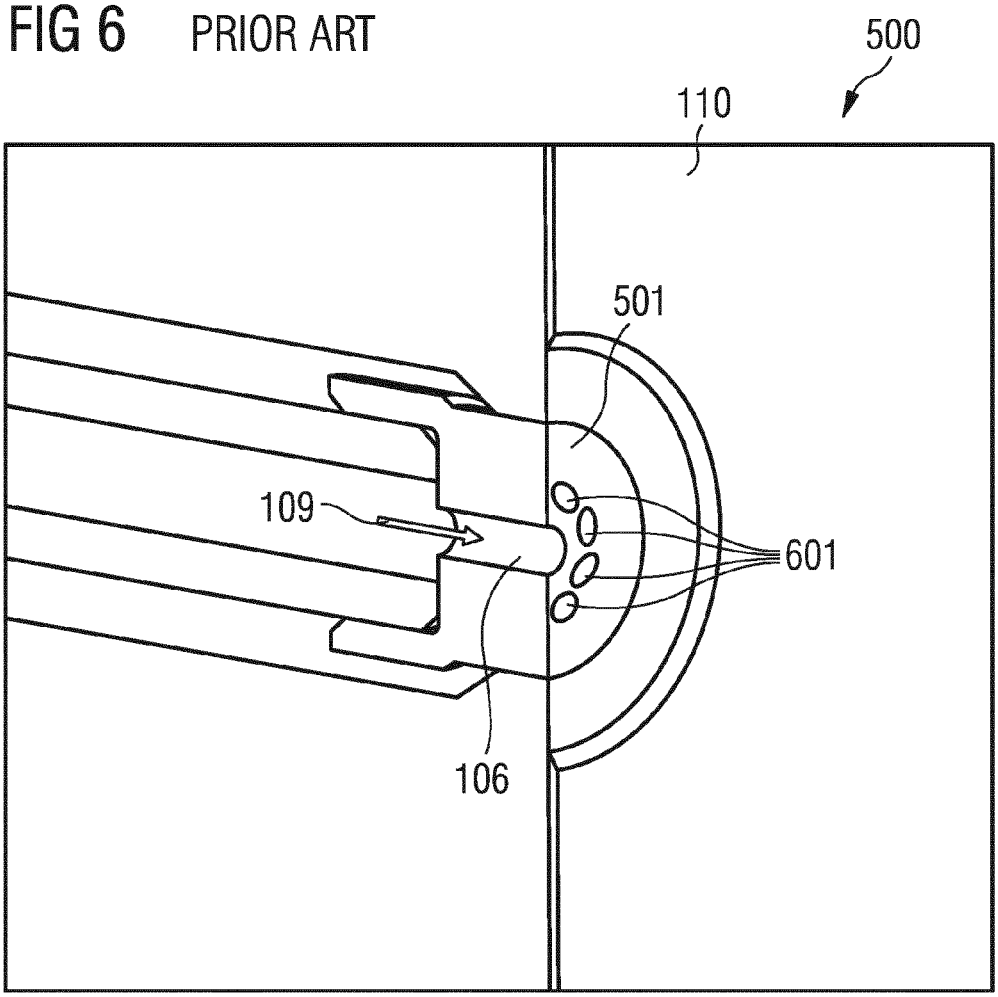
FIG 6 PRIOR ART

FIG. 4 shows a perspective view of a combustion chamber 100 with similar features as in the embodiment shown in FIG. 2, wherein the wall section 101 is in direct contact with the burner body 110. The inner face 104 of the wall section 101 has the normal n. Brim element 103 is formed to the inner face 104 or the brim element 103 may be mounted for example by welding or laser deposition. The brim element 103 extends with an extending direction parallel to the inner face 104.

Moreover, FIG. 4 shows a helical run of a portion of the inlet channel 102. As shown in FIG. 4, the inlet channel 102 runs in a helical manner around the fuel channel 201. Moreover, the inlet channel 102 is in thermal contact with the fuel injection aperture 106 such that the cooling medium inside the inlet channel 102 already cools the lance tip in the fuel injection aperture 106 outside the fuel channel 201.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

The invention claimed is:

1. A combustion chamber for a gas turbine, comprising:

a wall section comprising an inlet channel for injecting a cooling medium into the combustion chamber, and a brim element mounted to an inner face of the wall section, wherein the brim element is formed in such a way that a projected area of the brim element onto the inner face along a direction of a normal of the inner face at least partially covers the inlet channel, wherein the wall section further comprises a fuel injection aperture through which fuel is injectable into the combustion chamber, wherein the wall section further comprises a groove formed within the inner face, wherein the groove forms a part of an end section of the inlet channel, wherein the groove is formed such that the groove runs at least partially along a predefined direction configured to guide the cooling medium to stream through the inlet channel, wherein the groove has a curved shape along a circumferential direction around a center axis of the fuel injection aperture, wherein the inlet channel forms together with an edge of the brim element and the inner face, an inlet aperture through which the cooling medium is configured to stream inside the combustion chamber, and wherein the brim element is configured to guide the cooling medium through the inlet aperture, partially along the circumferential direction around the center axis of the fuel injection aperture.

2. The combustion chamber according to claim 1, wherein the wall section further comprises at least one further inlet channel for injecting the cooling medium into the combustion chamber, wherein the combustion chamber further comprises at least one further brim element mounted to the inner face of the wall section, wherein the at least one further brim element is formed in such a way that a further projected area of the at least one further brim element onto the inner face along a direction of the normal of the inner face at least partially covers the at least one further inlet channel.

3. The combustion chamber according to claim 1, wherein in the combustion chamber, fuel droplets are injectable for streaming in a main fuel streaming direction, wherein the main fuel streaming direction comprises a direction component which is parallel to the inner face, and wherein the brim element is formed and adjusted to the wall section in such a way that the brim element is configured to generate the inlet aperture through which the injected cooling medium is guided from a lee side of the brim element along a downstream direction along the direction component of the main fuel streaming direction.

4. The combustion chamber according to claim 1, wherein the inlet channel is formed within the wall section in such a way that the inlet channel comprises a section running in a helical way.

5. The combustion chamber according to claim 1, wherein the inlet channel is formed within the wall section in such a way that the inlet channel comprises a section running parallel with respect to the normal of the inner face.

6. The combustion chamber according to claim 1, wherein the wall section is surrounded by a spacer element.

7. The combustion chamber according to claim 6, wherein the spacer element has a width of more than 1.5 times and less than 4 times that of the wall section.

8. The combustion chamber according to claim 6, wherein the spacer element has a width of more than 2 times and less than 4 times that of the wall section.

9. The combustion chamber according to claim 6, wherein the spacer element is a titanium alloy.

10. The combustion chamber according to claim 1, wherein the inner face of the wall section and/or the brim element is a titanium alloy.

11. The combustion chamber according to claim 1, further comprising a burner body with a receiving section into which the wall section is mounted in a detachable manner.

12. The combustion chamber according to claim 11, wherein the burner body comprises a pilot tip mounted to an opening of the burner body, and wherein the pilot tip forms a mounting face to which the wall section is mounted.

13. A method for controlling a flow of a cooling medium inside a combustion chamber for a gas turbine, comprising:

injecting the cooling medium into the combustion chamber through at least one inlet channel of a wall section of the combustion chamber; and controlling the flow of the cooling medium inside the combustion chamber by a brim element mounted to an inner face of the wall section, wherein the brim element is formed in such a way that a projected area of the brim element onto the inner face along a direction of a normal of the inner face at least partially covers the inlet channel, wherein the wall section further comprises a groove formed within the inner face, wherein the groove forms a part of an end section of the inlet channel, wherein the groove is formed such that the groove runs at least partially along a predefined direction for guiding the cooling medium streaming through the inlet channel, wherein the groove has a curved shape along the circumferential direction around a center axis of the fuel injection aperture, wherein the inlet channel forms together with an edge of the brim element and the inner face, an inlet aperture through which the cooling medium streams inside the combustion chamber, wherein the wall section further comprises a fuel injection aperture through which fuel is injectable into the combustion chamber, and wherein the brim element is formed in such a way that the cooling medium streaming through the inlet aperture is guided partially along a circumferential direction around a center axis of the fuel injection aperture.

* * * * *